United States Patent [19]

Gibson

[11] Patent Number: 4,581,498

[45] Date of Patent: Apr. 8, 1986

[54] REEL HAVING A REMOVABLE HUB

[75] Inventor: Melvin G. Gibson, Edmond, Okla.

[73] Assignee: Transworld Drilling Company, Oklahoma City, Okla.

[21] Appl. No.: 587,629

[22] Filed: Mar. 8, 1984

[51] Int. Cl.[4] ..... H02G 11/02; B65H 75/22

[52] U.S. Cl. ..... 191/12.2 R; 242/115; 242/118.4

[58] Field of Search ..... 191/12.2 R, 12.2 A, 191/12.4; 242/115, 118.4, 118.8, 84.8, 96

[56] References Cited

U.S. PATENT DOCUMENTS

| | | | |
|---|---|---|---|
| 1,704,151 | 3/1929 | Simpson | 242/118.4 X |
| 3,001,738 | 9/1961 | Quenot | 242/84.8 |
| 3,565,363 | 2/1971 | Mizuguchi et al. | 242/115 |
| 3,806,059 | 4/1974 | Quenot | 242/96 X |
| 3,830,443 | 8/1974 | Quenot | 242/96 X |
| 3,870,245 | 3/1975 | Witteborg, Jr. | 242/118.4 X |
| 3,979,833 | 9/1976 | Grundman | 242/96 X |
| 3,983,977 | 10/1976 | Crabb | 191/12.4 |
| 4,106,719 | 8/1978 | Haverland | 242/96 |
| 4,134,746 | 3/1979 | Lowery | 191/12.4 |
| 4,261,525 | 4/1981 | Wagner | 242/96 X |
| 4,272,036 | 6/1981 | Waterman | 242/96 |
| 4,284,180 | 8/1981 | Masters | 191/12.2 R |
| 4,318,461 | 3/1982 | Brorein | 191/12.2 R |

OTHER PUBLICATIONS

Photograph of commercially available reel.
Specification sheet for exhibit A.

*Primary Examiner*—Robert B. Reeves
*Assistant Examiner*—David F. Hubbuch
*Attorney, Agent, or Firm*—William G. Addison

[57] ABSTRACT

An improved reel having a hub and a removable hub. The hub has a diameter and the removable hub is adapted to be removably connected to the reel and about the hub. The removable hub has a diameter which is larger than the diameter of the hub. The removable hub provides a convenient means for effectively changing the diameter of the portion of the reel about which a cable is wound.

15 Claims, 8 Drawing Figures

REEL HAVING A REMOVABLE HUB

CROSS-REFERENCE TO RELATED APPLICATION

The subject matter in the present application is related to the subject matter disclosed in the co-pending application entitled SYSTEM FOR MONITORING CATHODIC PROTECTION SYSTEMS OF MARINE INSTALLATIONS INCLUDING AN IMPROVED REEL, U.S. Ser. No. 587,627, filed Mar. 8, 1984, and assigned to the assignee of the present invention.

The subject matter of the present invention is related to the subject matter disclosed in the co-pending application entitled "System for Monitoring Cathodic Protection Systems of Marine Installations Including an Improved Reel", filed on even date herewith and assigned to the assignee of the present invention.

FIELD OF THE INVENTION

The present invention relates generally to an improved reel and, more particularly, but not by way of limitation, to an improved reel having a removable hub for effectively changing the usable hub diameter.

DESCRIPTION OF THE PREFERRED EMBODIMENT

Figure 1:
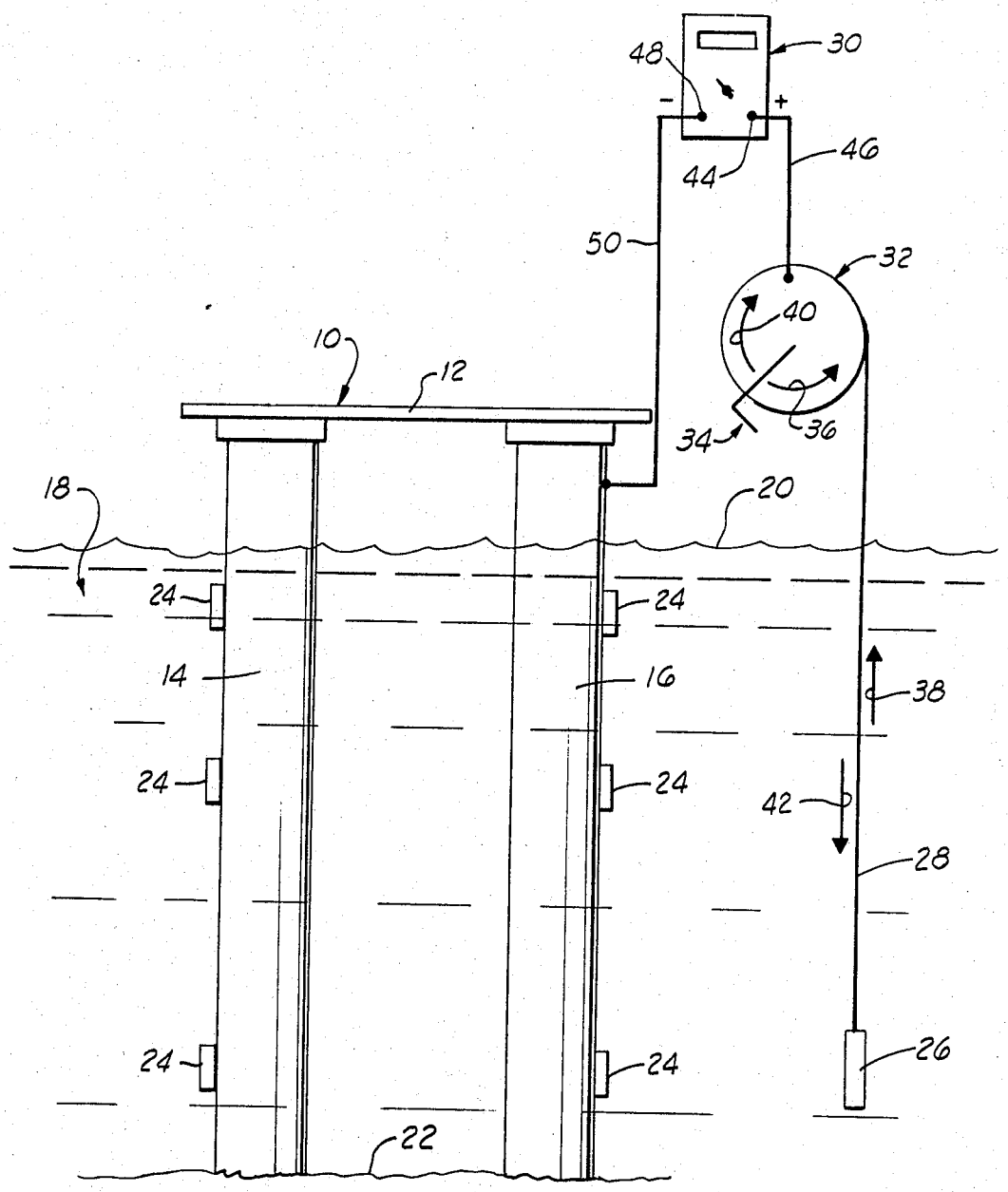
FIG. 1 is a schematic, diagrammatic view of a marine installation and a system for measuring cathodic reference potentials to monitor the effectiveness of the cathodic protection system using the improved reel which is constructed in accordance with the present invention.

Various cathodic protection systems have been developed for controlling corrosion of various structures. Marine installations such as off-shore production platforms and off-shore drilling rigs utilize cathodic protection systems for controlling corrosion on submerged surfaces. Shown in FIG. 1 is a diagrammatic view of a marine installation 10 having a platform 12 with legs 14 and 16 connected to the platform 12 and extending into a body of water 18 having a surface 20 and a floor 22. It should be noted that off-shore marine installations commonly include a plurality of legs and only two legs have been shown in FIG. 1 for the purpose of illustrating the present invention. The legs 14 and 16 support the platform 12 above the surface 20 of the body of water 18 and one end of each of the legs 14 and 16 is supported on the floor 22 of the body of water 18.

In a cathodic protection system for off-shore marine installations it is common to install sacrificial electrodes on the legs 14 and 16 (submerged surfaces) at various spaced apart positions along the length of the legs 14 and 16, thereby positioning the sacrificial electrodes on each leg 14 and 16 at various depths in the body of water 18 (three electrodes 24 being shown in FIG. 1 on each leg 14 and 16 for example, although in an actual off-shore marine installation many more sacrificial electrodes commonly are connected to the legs). During the functioning of the cathodic protection system, the sacrificial electrodes 24 deteriorate and, when the sacrificial electrodes 24 deteriorate to a known extent, the cathodic protection system for the submerged surfaces becomes ineffective to control corrosion. Thus, it is necessary from time-to-time to monitor the deterioration of the sacrificial electrodes 24 or, in other words, to monitor the effectiveness of the cathodic protection system so the sacrificial electrodes 24 can be replaced before the deterioration of such sacrificial electrodes 24 reaches such an extent that the cathodic protection system becomes ineffective to control corrosion of the submerged surfaces. The effectiveness of the cathodic protection system is measured by periodically measuring the cathodic reference potentials using a reference electrode positioned within the area of influence of the sacrificial electrodes 24.

To measure the cathodic reference potentials, a reference electrode 26 is attached to one end of an insulated cable 28 so the reference electrode 26 is in electrical communication with the cable 28. The cable 28 is utilized to lower the reference electrode 26 in the body of water 18 to a predetermined depth (within the influence of one or more of the sacrificial electrode 24). The opposite end of the cable 28 is connected to a voltmeter 30 and the voltmeter 30 also is connected to the marine installation 10, as shown in FIG. 1, thereby connecting the cable 28 to the marine installation 10 through the voltmeter 30 and establishing electrical continuity between the reference electrode 26 and the marine installation 10 through the cable 28 and the voltmeter 30 which is interposed between the reference electrode 26 and the marine installation 10. The cathodic reference potential then is provided by the voltmeter 30 readout. This process is repeated numerous times and at various times and, with respect to an off-shore marine installation, this process typically may have to be repeated several times in connection with a single monitoring of the cathodic protection system.

As shown in FIG. 1, the end of the cable 28, opposite the end connected to the reference electrode 26 more particularly is connected to a reel 32 having a handle assembly 34 and the reel 32 is connected to the marine installation 10 through the voltmeter 30. The handle assembly 34 is connected to a portion of the reel 32 so that rotation of the handle assembly 34 in a winding direction 36 winds portions of the cable 28 onto a portion of the reel 32 thereby moving the reference electrode 26 in a generally upwardly direction 38 through the body of water 18 and so that rotation of the handle assembly 34 in another opposite unwinding direction 40 unwinds portions of the cable 28 from a portion of the reel 32 thereby moving the reference electrode 26 in a generally downwardly direction 42 through the body of water 18 for positioning the reference electrode 26 at the various positions for determining the cathodic reference potentials in the manner mentioned before.

More particularly, the voltmeter 30 includes a plug receiver 44 and a plug on one end of a cable connector 46 is removably disposed in the plug receiver 44, the opposite end of the cable connector 46 being connected to the reel 32 in a manner to be described in greater detail below. The voltmeter 30 also includes a plug receiver 48 and a plug on one end of a cable connector 50 is removably disposed in the plug receiver 48, the opposite end of the cable connector 50 being connected to the marine installation 10. The cable connectors 46 and 50 cooperate with the cable 28 and the reel 32 to establish electrical continuity between the reference electrode 26 and the marine installation 10 by way of the voltmeter 30.

The cathodic protection system just described in connection with the marine installation 10 and the use of a reference electrode connected to one end of a cable with the opposite end of the cable being connected to the marine installation through a voltmeter and a reel for positioning the reference electrode with the reel being connectable to the cable and to the voltmeter for determining cathode reference potentials are well known in the art. However, the present invention, more particularly, provides an improved reel 32 for use in monitoring such cathodic protection systems.

The improved reel 32 is shown in FIGS. 2, 3, 4 and 5 in greater detail. The improved reel of the present invention includes the handle assembly 34, a hub assembly 52, a removable hub 53 (shown in FIG. 2), 52, a frame assembly 54, a contactor assembly 56, a cable guide 58, a reel grip 60, and a meter support 62.

The reel 32, having the handle assembly 34, the hub assembly 52, the frame assembly 54, the contactor assembly 56, the cable guide 58, the reel grip 60 and the meter support 62, is disclosed and described in detail in the co-pending application entitled "System for Monitoring Cathodic Protection Systems of Marine Installations Including an Improved Reel" and the disclosure in this co-pending application hereby specifically is incorporated by reference. The present invention specifically is directed to the removable hub 53 of the reel 32.

The hub assembly 52 is rotatingly supported on the frame assembly 54 so that the hub assembly 52 is rotatable in the winding and unwinding directions 36 and 40, respectively, and the handle assembly 34 is connected to the hub assembly 52 so that the handle assembly 34 is rotatable in the directions 36 and 40 for rotating the hub assembly 52 in the directions 36 and 40. The contactor assembly 56 has a rotatable portion which is connected to the hub assembly 52 and which rotates with the rotation of the hub assembly 52, and a non-rotatable portion which is mounted on the frame assembly 54 and which has a portion slidingly contacting the rotatable portion of the contactor assembly 56. The meter support 62 is connected to the frame assembly 54 and the meter support 62 is adapted to receive and supportingly retain the voltmeter 30 (the voltmeter 30 being shown diagrammatically in FIG. 1 and being shown in dashed lines retained within the meter support 62 in FIG. 4). The non-rotatable portion of the contactor assembly 56 is adapted to be connected to the voltmeter 30 which is disposed within and supported by the meter support 62 which is connected to the frame assembly 54. Thus, the voltmeter 30 is supportable on the reel 32.

The cable guide 58 is connected to the frame assembly 54 and the cable guide 58 is adapted to guidingly receive portions of the cable 28, the cable guide 58 cooperating to guide the cable 28 with respect to the hub assembly 52 as portions of the cable 28 are being wound onto the hub assembly 52 and as portions of the cable 28 are being unwound from the hub assembly 52. One end portion of the cable 28, opposite the end portion of the cable 28 which is connected to the reference electrode 26, extends through the cable guide 58 and this end portion of the cable 28 is operatively connected to the hub assembly 52 in a manner which will be described in greater detail below (the cable 28 being shown in FIG. 5 extending through the cable guide 58). The end of the end portion of the cable 28 which is operatively connected to the hub assembly 52 is connected to the rotatable portion of the contactor assembly 56 so electrical continuity is established and maintained between the reference electrode 26 and the rotatable portion of the contactor assembly 56 during the rotation of the hub assembly 52 and the rotatable portion of the contactor assembly 56 connected thereto. The sliding contact maintained between the non-rotatable portion of the contactor assembly 56 and the rotatable portion of the contactor assembly 56 is adapted to establish electrical continuity between the rotatable portion and the non-rotatable portion of the contactor assembly and, thus, the sliding contact between the rotatable portion and the non-rotatable portion of the contactor assembly 56 is adapted to maintain electrical continuity between the reference electrode 26 and the non-rotatable portion of the contactor assembly 56 during the rotation of the hub assembly 52 and the rotatable portion of the contactor assembly 56 connected thereto. The non-rotatable portion of the contactor assembly 56 is adapted to be connected to the voltmeter 30 for establishing electrical continuity between the contactor assembly 56 and the voltmeter 30 or, in other words, for establishing electrical continuity between the reference electrode and the voltmeter 30 by way of the cable 28 and the contactor assembly 56 and the connection between the contactor assembly 56 and the voltmeter 30 provided by the cable connector 46.

Figure 2:
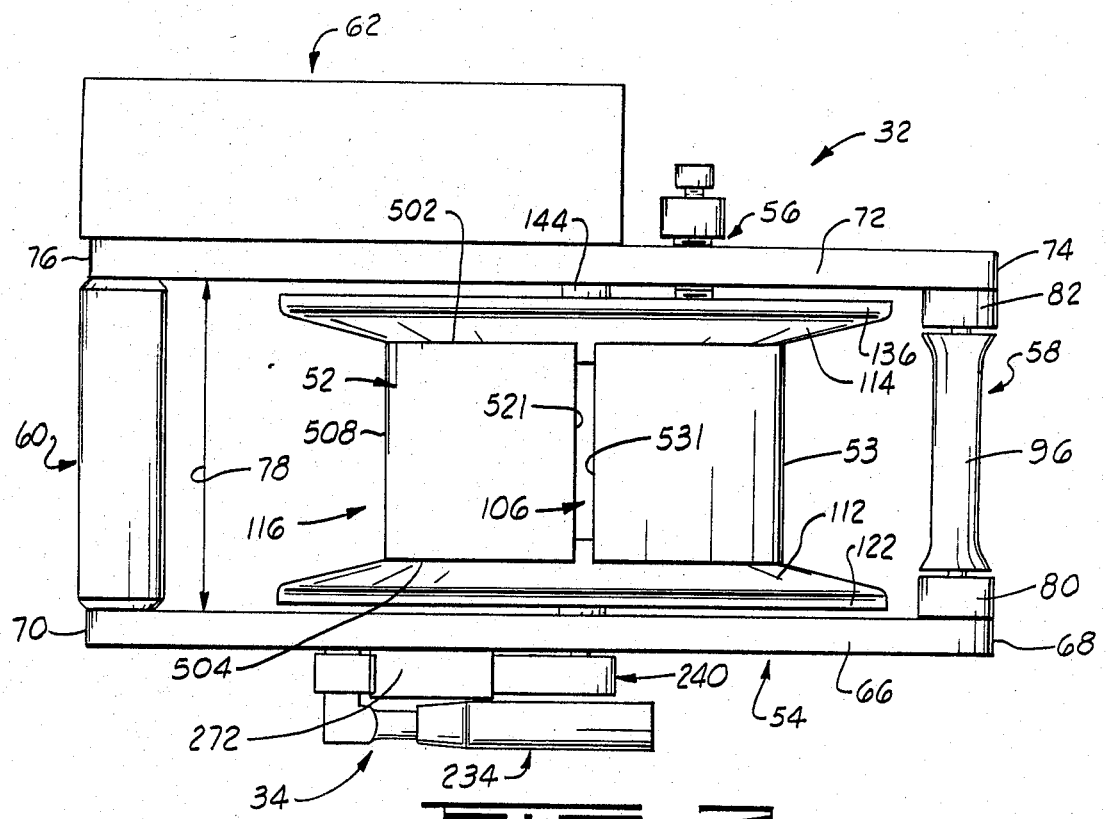
FIG. 2 is a plan view of the reel used in the system shown in FIG. 1 showing the removable hub assembled thereon.
Figure 3:
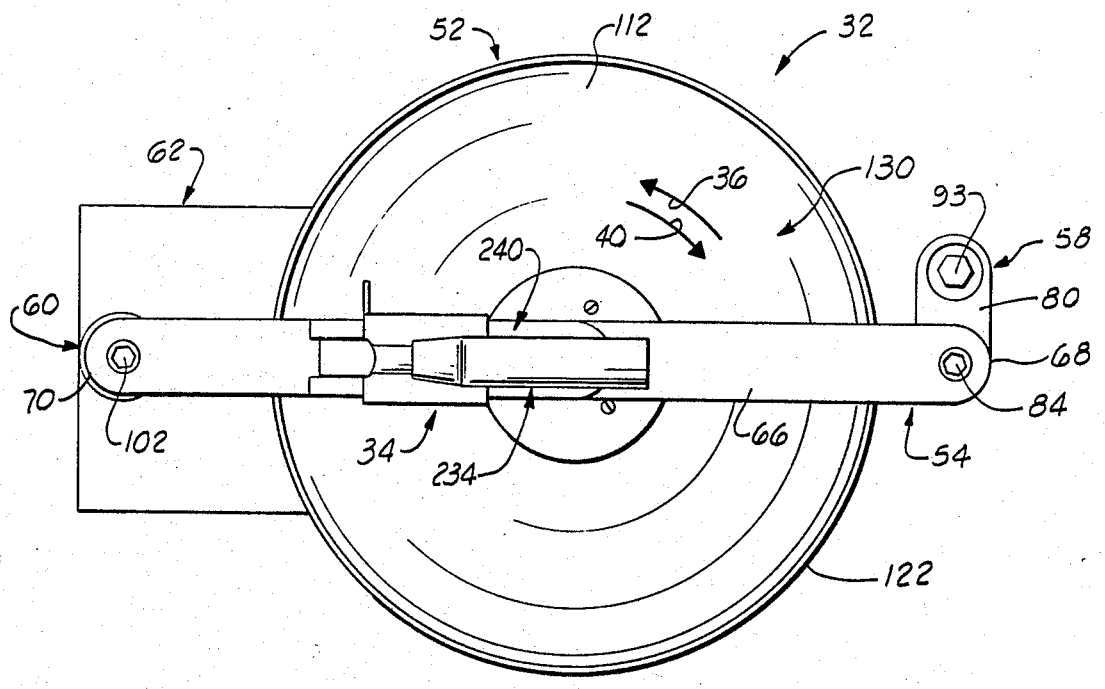
FIG. 3 is an elevational view of one side of the reel shown in FIG. 2.
Figure 5:
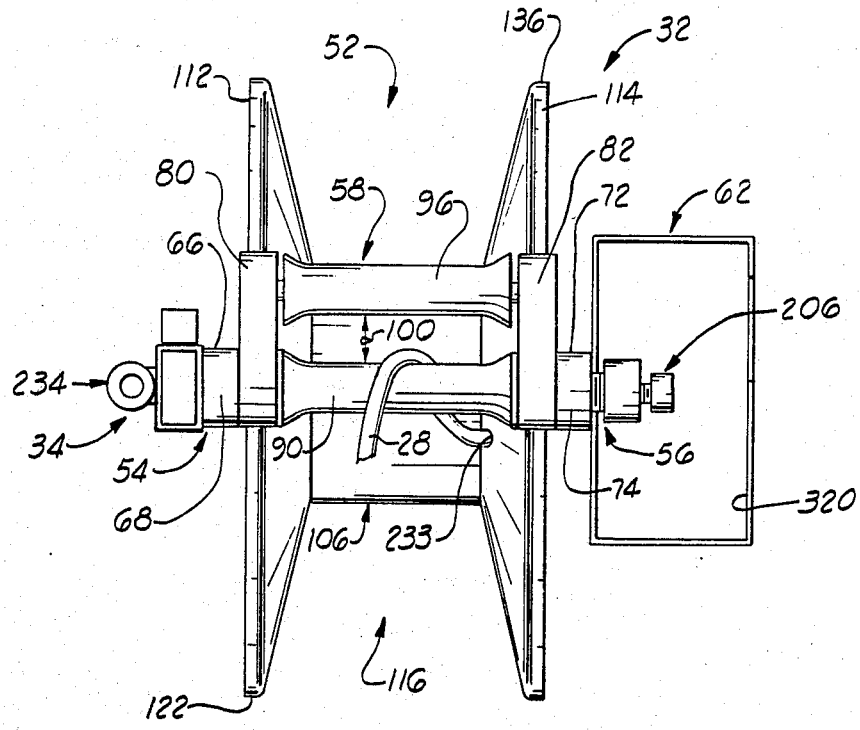
FIG. 5 is an elevational view of one end of the reel shown in FIGS. 2, 3 and 4 without the removable hub.

The handle assembly 34 has an operating position and a locked position, the handle assembly 34 being shown in the locked position in FIGS. 2, 3 and 5 and the handle assembly 34 being shown in the operating or unlocked position in FIG. 16, for example. A portion of the handle assembly 34 is connected to the hub assembly 52 and a portion of the handle assembly 34 is removably connectable to a portion of the frame assembly 54. When the handle assembly is moved to the locked position, a portion of the handle assembly 34 is removably connected to a portion of the frame assembly 54 for locking the hub assembly 52 and the handle assembly 34 to the frame assembly 54 to prevent rotation of the handle assembly 34 and the hub assembly 52 connected thereto. When the handle assembly 34 is moved from the locked position to the operating position, the handle assembly 34 is removed or disconnected from the frame assembly 34 and the handle assembly 34 is positioned for rotating the handle assembly 34 and the hub assembly 52 connected thereto in the directions 36 and 40.

In operation, the end of the cable 28, opposite the end of the cable 28 which is connected to the reference electrode 26, is disposed through the cable guide 58 (shown in FIG. 5) and this end portion of the cable 28 is operatively connected to the hub assembly 52 in a manner to be described in greater detail below. Further, the end of the cable 28, opposite the end of the cable 28 which is connected to the reference electrode 26, is connected to the rotatable portion of the contactor assembly 56, also in a manner to be described in greater detail below. The voltmeter 30 is disposed and maintained within the meter support 62. One end of the cable connector 46 then is removably connected to the non-rotatable portion of the contactor assembly 56 and the opposite end of the cable connector 46 then is removably connected to the plug receiver 44 on the voltmeter 30. One end of the cable connector 50 is connected to the plug receiver 48 on the voltmeter 30 and the opposite end of the cable connector 50 is connected to the marine installation 10. Thus, electrical continuity is established between the reference electrode 26 and the rotatable portion of the contactor assembly 56 by way of the cable 28, electrical continuity is established between the rotatable portion and the non-rotatable portion of the contactor assembly 56 thereby establishing electrical continuity between the reference electrode 26 and the non-rotatable portion of the contactor assembly 56 by way of the cable 28 and the sliding contact between the rotatable portion and the non-rotatable portion of the contactor assembly 56, electrical continuity is established between the non-rotatable portion of the contactor assembly 56 and the voltmeter 30 by way of the cable connector 46 and electrical continuity is established between the voltmeter 30 and the marine installation 10 by way of the cable connector 50. Thus, in this operating position, electrical continuity is established between the reference electrode 26 and the marine installation 10 by way of the reel 32 and the voltmeter 30, and the sliding contact between the rotatable portion and the non-rotatable portion of the contactor assembly 56 operates to maintain electrical continuity between the cable 28 and the voltmeter 30 as the hub assembly 52 and the rotatable portion of the contactor assembly 56 are rotated in the directions 36 and 40. The operator with the reel 32 then positions the reel 32 in a position generally on the platform 10 for lowering the cable 28 into the body of water 18. The operator then moves the handle assembly 32 from the locked position to the operating position and the operator rotates the handle assembly 34 in the unwinding direction 40 thereby causing portions of the cable 28 which are wound onto the hub assembly 54 to be unwound from the hub assembly 54 and thereby lowering the cable 28 and the reference electrode 26 connected thereto into the body of water 18 in the direction 42. The operator lowers the cable 28 and the reference electrode 26 connected thereto in the direction 42 until the reference electrode 26 is positioned within the area of influence of one of the sacrificial electrodes 24 (the voltmeter 30 readout provides the indication to the operator that the reference electrode 26 in fact has been positioned within the area of influence of one of the sacrificial electrodes) and, when the reference electrode 26 has been positioned in the area of influence of one of the sacrificial electrodes, the operator reads the cathodic reference potential from the readout of the voltmeter 30. During the positioning of the reference electrode 26 within the area of influence of one of the sacrificial electrodes 24, it also may be necessary for the operator to move the reference electrode 26 in the generally upwardly direction 38 by rotating the handle assembly 34 in the winding direction 36. This process is repeated numerous times, as mentioned before, to determine the various cathodic reference potentials for determining the effectiveness of the protection provided by the cathodic protection system.

At various times during the process of determining the cathodic reference potentials, it becomes necessary to set the reel 32 on the surface of the platform 12 or, in other words, it becomes necessary for the operator to ungrip the handle assembly 34. If the handle assembly 34 is released by the operator, the weight of the reference electrode 26 combined with the unreeled portions of the cable 28 causes the hub assembly 52 inadvertently to rotate in the unwinding direction 40 thereby inadvertently unwinding portions of the cable 28 from the hub assembly 52 and causing the hub assembly 52 physically to rotate in the direction 40 thereby moving the reel 32 when the reel 32 is positioned on a surface in such a manner that the hub assembly 52 can cause the reel 32 to be so moved. Thus, when it becomes necessary for the operator to release the handle assembly 34, the operator moves the handle assembly 34 from the operating position to the locked position wherein a portion of the handle assembly 34 is removably connected to the frame assembly 54 thereby locking the handle assembly 34 along with the hub assembly 52 connected thereto to the frame assembly 54 and preventing rotation of the handle assembly 34 or the hub assembly 52 connected thereto in either the direction 36 or 40.

The portion of the hub assembly 52 about which the cable 28 is wound has a fixed diameter. In some applications, it is desirable to increase this diameter and, in these instances, the removable hub 53 is removably connected to the reel 32. When the removable hub 53 is connected to the reel 32, the cable 28 is wound about and unwound from the outer peripheral surface of the removable hub 53.

For example, in one particular embodiment, the portion of the hub assembly 52 about which the cable 28 is wound has a diameter of about 2.5 inches and, in this instance, about 300 feet of the cable 28 can be wound about the hub assembly 52. In some applications, only a small portion of this cable 28 length is needed and, in these instances, it is desirable to connect the smaller length of the cable 28 to the reel 32 so the operator does not have to carry and manipulate the larger bulk and weight associated with the longer cable 28 length. For example, in some applications, only 25 feet of the cable 28 is required. In these instances involving the shorter cable 28 length, the removable hub 53 is connected to the reel 32 and the cable 28 is wound about and unwound from the removable hub 53. In one particular embodiment, the removable hub 53 has a diameter of about 5.5 inches when assembled on the reel 32, as opposed to the 2.5 inch diameter of the hub assembly 52, and thus the shorter length cable 28 is wound onto and unwound from this larger diameter removable hub 53. The larger diameter removable hub 53 permits or allows a substantially greater length of the cable 28 to be wound onto or unwound from the removable hub 53 per turn of the removable hub 53 and, therefore, the handle assembly 34 is rotated a fewer number of turns as compared to the number of turns which would be required to release or retract the same length of the cable 28 using the smaller diameter hub assembly 52.

The frame assembly, as shown in FIGS. 2, 3, 4 and 5, includes a first frame rail 66, having opposite first and second ends 68 and 70, respectively, and a second frame rail 72 having opposite first and second ends 74 and 76, respectively. The first and second frame rails 66 and 72 are positioned in a spaced apart relationship with the first end 68 of the first frame rail 66 being generally aligned with the first end 74 of the second frame rail 72, and with the second end 70 of the first frame rail 66 being generally aligned with the second end 76 of the second frame rail 72. The first and the second frame rails 66 and 72 extend in generally parallel planes and the first frame rail 66 is spaced a distance 78 (shown in FIG. 2) from the second frame rail 72.

The cable guide 58 is connected to the first ends 68 and 70 of the first and the second frame rails 66 and 72 and the cable guide 58 extends generally between the first ends 68 and 64 of the first and the second frame rails 66 and 72. The cable guide 58, not only functions to receive and guide portions of the cable 28, but the cable guide 58 also functions to connect the first ends 68 and 74 of the first and the second frame rails 66 and 62 and to support the first and the second frame rails 66 and 72 in the spaced apart relationship. Thus, in one sense, the cable guide 58 also functions as a part of the frame assembly 54.

As shown in FIGS. 2, 3, 4 and 5, the cable guide 58 includes a first bar 80 and a second bar 82. One end of the first bar 80 is secured to the first end 68 portion of the frame rail 66 by a fastener 84 and the first bar 80 extends a distance generally perpendicularly upwardly from the first end 68 portion of the first frame rail 66. One end of the second bar 82 is secured to the first end 74 portion of the second frame rail 72 by a fastener 86 and the second bar 82 extends a distance generally perpendicularly upwardly from the first end portion of the second frame rail 72. The first bar 80 is spaced a distance from the second bar 82 and the first bar 80 generally is aligned with the second bar 82.

One end of a first shaft (now shown) is secured to the first bar 80 by way of the fastener 84 and the opposite end of the first shaft is secured to the second bar 82 by the fastener 86, the fasteners 84 and 86 thus being oriented in an aligned relationship. A first roller 90 is rotatingly supported on the first shaft.

One end of a second shaft (not shown) is secured to the first bar 80 by way of a nut 93 which threadedly engages one end of the second shaft and which engages a portion of the first bar 80, and the opposite end of the second shaft is secured to the second bar 82 by way of a nut 95 which is threadedly secured to one end of the second shaft in which engages a portion of the second bar 82. One end of the second shaft extends through an opening formed in the first bar 80 and the nut 93 threadedly engages this end of the second shaft and a portion of the first bar 80 to securedly connect the second shaft to the first bar 80. The opposite end of the second shaft extends through an opening formed in the second bar 82 and the nut 95 threadedly engages this end of the second shaft and a portion of the second bar 82 to securedly connect this end of the second shaft to the second bar 82. A second roller 96 is rotatingly supported on the second shaft.

The first roller 90 extends generally parallel with the second roller 96 and the outer peripheral surface of the first roller 90 is spaced a distance 100 from the outer peripheral surface of the second roller 96 to form a cable receiving opening therebetween adapted to receive portions of the cable 28 during the operation of the reel 32. The distance 100 is larger than the diameter formed by the outer peripheral surface of the cable 28, as shown in FIG. 5, so portions of the cable 28 easily extend through the cable receiving opening formed between the first and the second rollers 90 and 96.

As shown in FIGS. 2 and 3, the reel grip 60 is a cylindrically shaped grip which preferably is constructed of a plastic material. One end of the reel grip 60 is secured to the second end 70 portion of the first frame rail 66 by a fastener 102 and the opposite end of the reel grip 60 is secured to the second end 76 portion of the second frame rail 72 by a fastener (not shown). The reel grip 60 generally is aligned with the cable guide 58, the reel grip 60 being spaced a distance from the cable guide 58 and the reel grip 60 being disposed generally on an opposite end or side of the reel 32 as opposed to the cable guide 58. The hub assembly 52 thus is supported generally between and spaced a distance from the reel grip 60 and the cable guide 58. The reel grip 60 extends between the second ends 70 and 76 of the first and the second frame rails 66 and 72 and the reel grip 60 connects the first and the second ends 70 and 76 of the first and the second frame rails 66 and 72. Thus, the reel grip 60 cooperates to support the first and the second frame rails 66 and 72 in the spaced apart relationship and, as such, the reel grip 60, in one sense, comprises a portion of the supporting structure of the frame assembly 54. The grip 60 is adapted to be operatively gripped by an individual to assist in enabling the individual to support the reel 32 by hand during operation of the reel 32.

As generally shown in FIGS. 2, 3, 4 and 5, the hub assembly 52 includes a cylindrically shaped hub 106 having opposite ends and an outer peripheral surface, the outer peripheral surface of the hub 106 defining the diameter of the hub 106. A central portion of a generally circularly shaped first side plate 112 is secured to the one end of the hub 106 and the first side plate 112 extends a distance radially outward from the outer peripheral surface of the hub 106. A central portion of a generally cylindrically shaped second side plate 114 is secured to the opposite end of the hub 106 and the second side plate 114 extends a distance radially outward from the outer peripheral surface of the hub 106. The hub 106 is adapted so that a portion of the cable 28 can be wound generally about and generally unwound from the outer peripheral surface of the hub 106, and the first and the second side plates 112 and 114 cooperate with the outer peripheral surface of the hub 106 to form a cable receiving space 116 for retaining portions of the cable 28 in a position generally wound about the hub 106, the first and the second side plates 112 and 114 cooperating to retain portions of the cable wound about the outer peripheral surface of the hub 106.

The cable guide 58, more particularly, functions to guide the cable 28 into the cable receiving space 116 and to prevent the cable 28 from contacting the outer peripheral surfaces 122 and 136 of the first and second side plates 112 and 114 as the cable 28 is wound onto or unwound from the hub assembly 52. The rotating outer peripheral surfaces 122 and 136 of the first and second side plates 112 and 114 can result in cutting the engaged portions of the cable 28 and the cable guide 58 cooperates to protect the cable 28 from such cutting.

The first side plate 112 extends a distance at an angle radially outward from the hub 106 terminating with the outer peripheral end surface 122 of the first side plate 112. Thus, in the assembled position, the first side plate 112 extends a distance radially outward at an angle from the outer peripheral surface of the hub 106 so a recessed area 130 (FIG. 3) is formed in the first side plate 112 with the first side plate 112 generally encompassing the recessed area 130, the plate 112 having a generally overall circular-dish shape.

The second side plate 114 extends a distance at an angle radially from the hub 106 terminating with the outer peripheral end surface 136 of the second side plate 114. Thus, in the assembled position, the second side plate 114 extends a distance radially outwardly at an angle from the outer peripheral surface of the hub 106 so a recessed area 140 (FIG. 4) is formed in the second side plate 114 with the second side plate 114 generally encompassing the recessed area 140, the second side plate 140 having a generally circular-dish shape.

Thus, the first and the second side plates 112 and 114 each extend radially outward from the hub 106 so the distance between the first and the second side plates 112 and 114 increases in a direction radially outward from the outer peripheral surface of the hub 106.

As generally shown in FIGS. 2, 3, 4 and 5, the contactor assembly 56 includes a rotatable portion and a non-rotatable portion, as mentioned before. The rotatable portion of the contactor assembly 56 includes a generally circularly shaped contactor plate 152. The contactor plate 152 is connected to one end of the hub 106 and the contactor plate 152 is disposed generally within a portion of the recessed area 140 formed by the second side plate 114. An insulator plate (not shown) is disposed generally between the hub 106 and the contactor plate 152.

The hub 106 is journally supported on the first and second frame rails 66 and 72 and the handle assembly 34 is connected to the hub 106 for rotating the hub 106 in the winding and unwinding directions 36 and 40. Since the contactor plate 152 of the contactor assembly 56 is connected to the hub 106, the contactor plate 152 also is rotated when the hub 106 is rotated.

Figure 4:
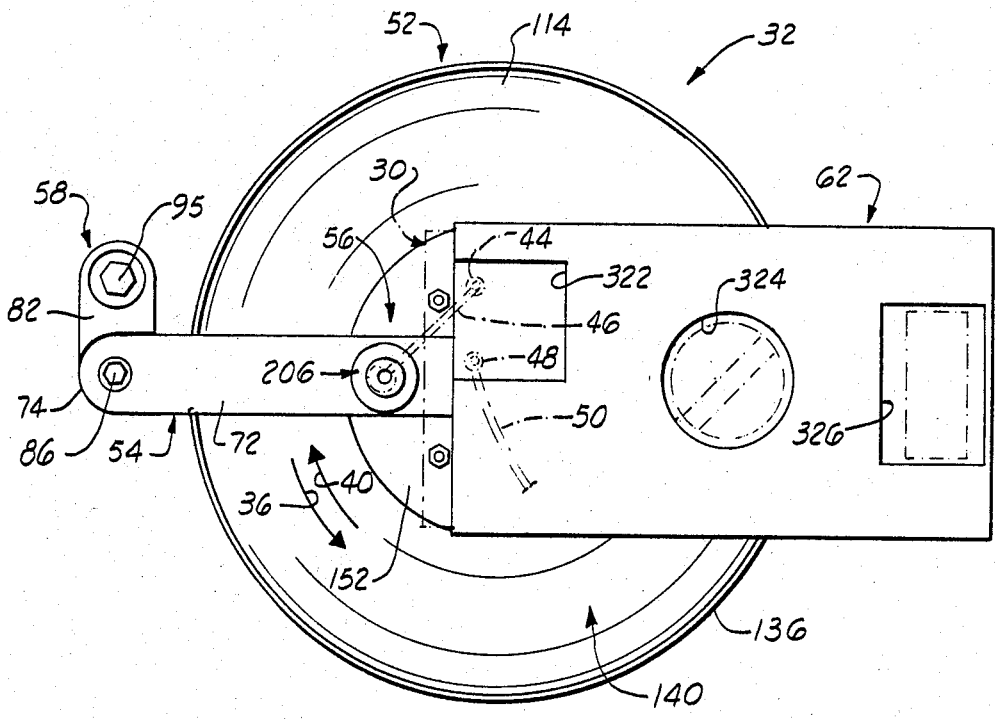
FIG. 4 is an elevational view of one side of the reel shown in FIGS. 2 and 3, opposite the side of the reel shown in FIG. 3.

As generally shown in FIGS. 2, 4 and 5, the contactor assembly 56 includes a non-rotatable portion which slidingly contacts the rotatable portion of the contactor assembly 56 to maintain electrical continuity during rotation of the hub 106 and the rotatable portion of the contactor assembly 56, as mentioned before. The non-rotatable portion of the contactor assembly 56, more particularly, includes a contactor 206 which is disposed through an opening formed in the second frame rail 72. A portion of the contactor 206 extends from the second frame rail 72 and slidingly engages the contactor plate 152. The end of the contactor 206, opposite the end which slidingly engages the contactor plate 152 is adapted to receive the plug on the end of the cable connector 46 for connecting the contactor 206 to the voltmeter 30.

An opening 233 (shown in FIG. 5) is formed through the second side plate 114 and the opening 233 is aligned with the passageway provided through a portion of the contactor assembly 56. One end of the cable 28 then is disposed through the cable receiving opening formed between the first and the second rollers 90 and 96 and this end of the cable 28 then is inserted through the opening 233 in the second side plate 114, this end of the cable 28 further being disposed or inserted through the passageway formed through a portion of the contactor assembly 56 to a position wherein this end of the cable 28 extends a distance above the contactor plate 152. The end of the cable 28 extending above the contactor plate 152 then is electrically connected to the contactor plate 152, and when the end of the cable 28 is secured to the contactor plate 152, the cable 28 is in electrical communication with the contactor plate 152. Thus, the reference electrode 26 is in electrical communication with the contactor plate 152 by way of the cable 28.

As shown in FIGS. 2, 3 and 4, the handle assembly 34 includes a handle 234 which is adapted to be gripped by an individual for hand operating the handle assembly 34 to rotate the handle assembly 34 in the directions 36 and 40 and for moving the handle assembly 34 to and from the locked and operating positions.

The handle assembly 34 also includes a handle arm 240 having one end of the hub 106. The handle 234 is pivotally connected to the handle arm 240.

As shown more clearly in FIGS. 4 and 5, the meter support 62 is generally rectangularly shaped and includes an opening 320 intersecting one end and extending a distance through the meter support 62. A slot 322 is formed in one side of the meter support 62 for providing access to the plug receivers 44 and 48 of the voltmeter 30. An opening 324 is formed in a central portion of one side of the meter support 62 for providing access to the dial on the voltmeter 30. An opening 326 also is formed through this side of the meter support 62 for providing visual access to the meter readout. The meter support 62 is connected to the second frame rail 72 for supporting the voltmeter 30 on the frame assembly 54.

Figure 6:
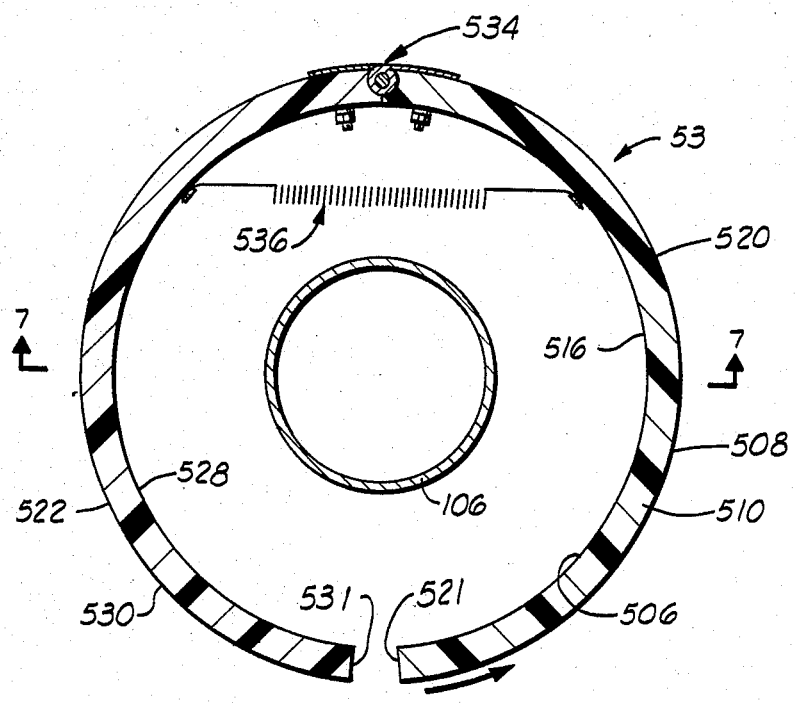
FIG. 6 is a cross section of the removable hub shown assembled about the hub which also is shown in cross-section.
Figure 7:
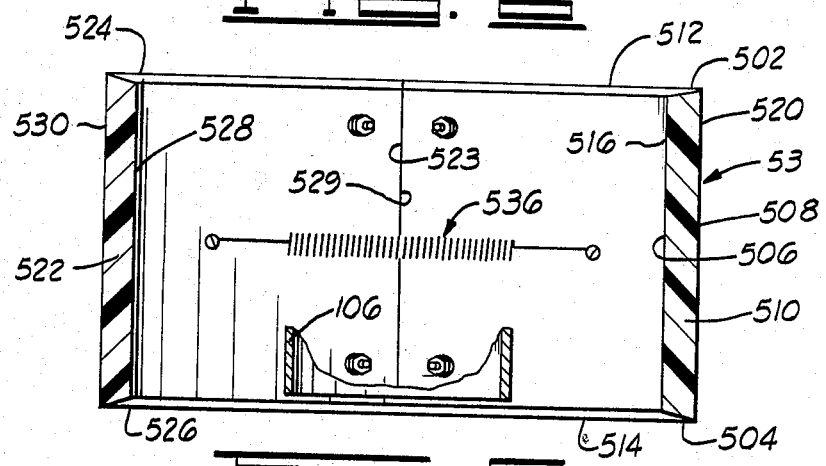
FIG. 7 is a cross section of the removable hub shown in FIG. 6, taken substantially along the line 7—7 of FIG. 6, and showing a portion of the hub.
Figure 8:
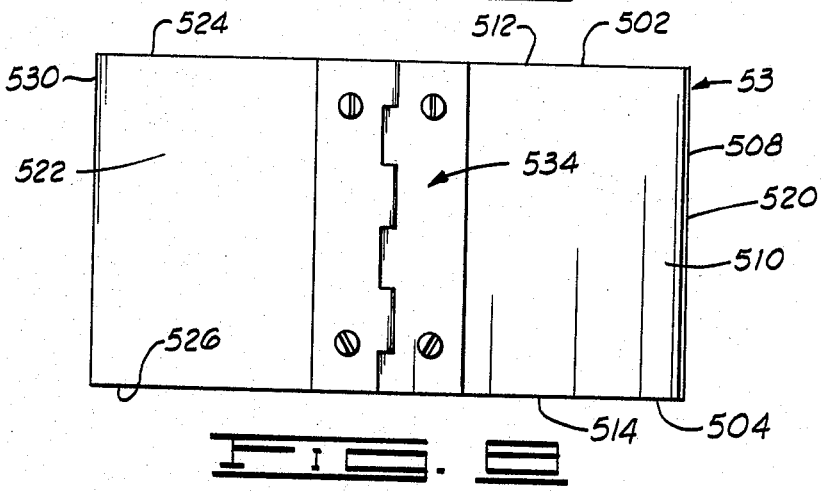
FIG. 8 is a plan view of the removable hub shown in FIGS. 6 and 7.

As shown more clearly in FIGS. 6, 7 and 8, the removable hub 53 has a first end 502, a second end 504 and an opening 506 which extends through a central portion thereof intersecting the first and second ends 502 and 504 and forming an inner peripheral surface. The removable hub 53 has a closed and an opened position and the inner peripheral surface formed by the opening 506 has a diameter which is larger than the diameter of the outer peripheral surface of the hub 106 so there is a clearance between the outer peripheral surface of the hub 106 and the inner peripheral surface of the removable hub 53 in the closed position of the removable hub 53 with the removable hub 53 assembled on the reel 32.

The removable hub 53 is generally cylindrically shaped and has an outer peripheral surface 508. When the removable hub 53 is removably connected to the reel 32, the cable 28 is wound about the outer peripheral surface 508 and the diameter of the outer peripheral surface 508 is the effective diameter of the removable hub 53 when the removable hub 53 is removably connected to the reel 32.

The removable hub 53 includes a first hub segment 510 having a first end 512, a second end 514, an inner peripheral surface 516 and an outer peripheral surface 520. The first hub segment 510 generally is shaped in the form of one-half of the cylindrical shape of the overall removable hub 53. The first hub segment 510 extends arcuately terminating in opposite first and second end faces 521 and 523. The first end face 521 is disposed about 180 degrees from the second end face 523, and the first and second end faces 521 and 523 each generally extend between the first and the second ends 512 and 514.

The removable hub 53 also includes a second hub segment 522 having a first end 524, a second end 526, an inner peripheral surface 528 and an outer peripheral surface 530. The second hub segment 522 generally is shaped in the form of one-half of the cylindrical shape of the overall removable hub 53. The second hub segment 522 extends arcuately terminating in opposite first and second end faces 531 and 529. The first end face 531 is disposed about 180 degrees from the second end face 529, and the first and the second end faces 531 and 529 each generally extend between the first and second ends 524 and 526.

In the assembled position, the first hub segment 510 is positioned near the second hub segment 522 with the first end face 521 being disposed generally adjacent the first end face 531 and with the second end face 523 being disposed generally adjacent the second end face 529. Further, in the assembled position, the first end 512 of the first hub segment 510 is coplanar with the first end 524 of the second hub segment 522, the first ends 512 and 524 of the first and the second hub segments 510 and 522 forming the first end 502 of the removable hub 53, and the second end 514 of the first hub segment 510 is coplanar with the second end 526 of the second hub segment 522, the second ends 514 and 526 forming the second end 504 of the removable hub 53.

A portion of a hinge 534 is connected to the first hub segment 510 generally near the second end face 523 and another portion of the hinge 534 is connected to the second hub segment 522 generally near the second end face 529. The hinge 534 hingedly connects the first and the second hub segments 510 and 522 to form the cylindrically shaped hub 53.

One end of a spring 536 is connected to the first hub segment 510 and the opposite end of the spring 536 is connected to the second hub segment 522. The spring 536 biases the first and the second hub segments 510 and 522 to the closed position wherein the first end face 521 of the first hub segment 510 is disposed near the first end face 531 of the second hub segment 531. The first and the second hub segments 510 and 522 are movable about the hinge 534 connection to the opened position wherein the first end faces 521 and 531 are spaced a distance apart.

In operation when it is desired to connect the removable hub 53, the first and the second hub segments 510 and 522 are pivoted in directions against the biasing force of the spring 536 to the opened position wherein the first end faces 521 and 531 are spaced a distance apart sufficient so the first and the second hub segments 510 and 522 are positionable generally about the hub 106, the hub 106 being moved through the opening provided by the space between the first end faces 521 and 531 as the removable hub 53 is positioned about the hub 106. The removable hub 53 is positioned about the hub 106 in the assembled position so the hub 106 is disposed generally within the opening 506 which extends through the removable hub 53, as shown more clearly in FIG. 6.

The width of the removable hub 53 between the first and the second ends 502 and 504 is sized so the first end 502 engages the second side plate 114 and the second end 504 engages the first side plate 112 and the removable hub 53 is wedged between the first and the second side plates 112 and 114 to secure the removable hub 53 in the assembled position on the reel 32. Further, the width of the removable hub 53 is sized so that, when the removable hub 53 is wedged in the closed position between the first and the second side plates 112 and 114, the first end face 521 is spaced a distance from the first end face 531, as shown more clearly in FIG. 2. When it is desired to remove the removable hub 53, an operator can obtain access to engage manually the first end faces 521 and 531 by way of the space therebetween and, then, the operator moves the first and the second hub segments 510 and 522 against the biasing force of the spring 536 to a position wherein the end faces 521 and 531 are separated a distance sufficient to remove the removable hub 53 from the hub 106.

Changes may be made in the construction and the operation of the various components and assemblies described herein without departing from the spirit and the scope of the invention as defined in the following claims.

What is claimed is:

1. A reel adapted to be operatively connected to one end of a cable for winding portions of the cable onto the reel and for unwinding portions of the cable from the reel, comprising:

a generally cylindrically shaped hub having a diameter determined by the outer peripheral surface thereof and being operatively connectable to one end portion of the cable, the hub being rotatable in a winding direction for winding portions of the cable onto the hub and being rotatable in an opposite unwinding direction for unwinding portions of the cable from the hub;

a frame assembly supporting the hub and the hub being rotatingly connected to the frame assembly for rotation in the winding direction and in the opposite unwinding direction;

a handle assembly connected to the hub and being adapted for rotating the hub in the winding direction and in the unwinding direction; and a removable hub having a first end, a second end, an outer peripheral surface and an opening extending therethrough intersecting the first and the second ends, the diameter determined by the outer peripheral surface of the removable hub being larger than the diameter determined by the outer peripheral surface of the hub, the removable hub being removably disposable about the hub and the removable hub being rotatable in the winding direction and in the unwinding direction when removably disposed about the hub so portions of the cable are wound onto the removable hub when the removable hub is rotated in the winding direction and so portions of the cable are unwound from the removable hub when the removable hub is rotated in the unwinding direction in lieu of winding and unwinding such cable on or from the hub.

2. The reel of claim 1 defined further to include:

a first side plate having an outer peripheral surface and being connected to one end of the hub, the first side plate being generally circularly shaped and extending a distance radially outwardly from the outer peripheral surface of the hub;

a second side plate having an outer peripheral surface and being connected to the opposite end of the hub, the second side plate being generally circularly shaped and extending a distance radially outwardly from the outer peripheral surface of the hub, the second side plate being spaced a distance from the first side plate by the hub and the space between the first and the second side plates cooperating with the outer peripheral surface of the hub to form a cable retaining space, the first and the second side plates cooperating with the hub to retain portions of the cable wound about the base generally within the cable retaining space.

3. The reel of claim 2 wherein the first end of the removable hub engages a portion of the second side plate and the second end of the removable hub engages a portion of the first side plate to wedge the removable hub generally between the first and the second side plates in an assembled position of the removable hub connected to the reel.

4. The reel of claim 3 wherein the removable hub is defined further to include:

a first hub segment having a first end, a second end, an inner peripheral surface, an outer peripheral surface, a first end face and a second end face, the first and the second end faces each generally extending between the first and the second ends of the first hub segment; and a second hub segment having a first end, a second end, an inner peripheral surface, an outer peripheral surface, a first end face and a second end face, the first and the second end faces each generally extending between the first and the second ends of the second hub segment, the first end face of the first hub segment being disposed near the first end face of the second hub segment and the second end face of the first hub segment being disposed near the second end face of the second hub segment in an assembled position of the first and the second hub segments.

5. The reel of claim 4 wherein the first ends of the first and second hub segments are disposed in a coplanar relationship and cooperate to form the first end of the removable hub, and wherein the second ends of the first and second hub segments are disposed in a coplanar relationship and cooperate to form the second end of the removable hub in an assembled position of the first and second hub segments, the inner peripheral surfaces of the first and second hub segments cooperating to form the opening through the removable hub and the outer peripheral surfaces of the first and second hub segments cooperating to form the outer peripheral surface of the removable hub in an assembled position of the first and second hub assemblies.

6. The reel of claim 5 wherein the width of the hub extending between the first and second ends of the hub is defined further as being sized to cooperate with the first and second side plates so the first end faces of the first and second hub segments are spaced a distance apart in the assembled position with the first and second hub segments wedged between the first and second side plates.

7. The reel of claim 5 defined further to include:

a hinge having a portion connected to the first hub segment generally near the second end face of the first hub segment and a portion connected to the second hub segment generally near the second end face of the second hub segment, the hinge hingedly connecting the first and the second hub segments for movement to the opened and closed positions, the first and the second hub segments being movable to the opened position wherein the first end faces of the first and second hub segments are spaced apart a distance sufficient to permit the first and the second hub segments to be positioned about the hub.

8. The reel of claim 4 wherein the first and the second hub segments each are arcuately shaped and wherein the removable hub is cylindrically shaped.

9. The reel of claim 1 wherein the handle assembly is defined further as including at least a portion movable from an operating position to a locked position and from a locked position to an operating position, a portion of the handle assembly being removably connected to a portion of the frame assembly when the handle assembly is moved to the locked position for locking the handle assembly and the hub connected thereto to the frame assembly for preventing rotation of the hub and the handle assembly connected thereto in the locked position of the handle assembly, the portion of the handle assembly removably connectable to a portion of the frame assembly being removed from connection with the frame assembly when the handle assembly is moved to the operating position of the handle assembly and the handle assembly being movable for rotating the handle assembly and the hub connected thereto in the winding direction and in the unwinding direction in the operating position of the handle assembly.

10. The reel of claim 1 wherein the frame assembly is defined further to include:

a first frame rail having a first end and a second end; and a second frame rail having a first end and a second end, the second frame rail extending in a plane generally parallel with the first frame rail and being spaced a distance from the first frame rail, the hub being disposed generally between the first frame rail and the second frame rail.

11. The reel of claim 10 defined further to include:

a cable guide disposed between the first and the second frame rails with one portion of the cable guide being connected to the first frame rail generally near the first end of the first frame rail and another portion of the cable guide being connected to the second frame rail generally near the first end of the second frame rail, the cable guide having a portion adapted to receive a portion of the cable and the cable being extendable through a portion of the cable guide when the cable is operatively connected to the hub, the cable guide cooperating to guide the cable during the winding of portions of the cable about the hub and during the unwinding of portions of the cable from the hub.

12. The reel of claim 10 defined further to include:

a reel grip having opposite ends, with one end of the reel grip being rotatingly connected to the first frame rail generally near the second end of the first frame rail with the opposite end of the reel grip being rotatingly connected to the second frame rail generally near the second end of the second frame rail, the reel grip being grippingly engageable by an individual for assisting the individual in supporting the reel, the reel grip being spaced a distance from the cable guide and the hub being disposed generally between the first and the second frame rails and generally between the cable guide and the reel grip, the reel grip being spaced a distance from the hub and the cable guide being spaced a distance from the hub.

13. The reel of claim 10 defined further to include: a contactor assembly having a rotatable portion connected to the end of the hub extending through the second frame rail so the rotatable portion of the contactor assembly rotates with the rotation of the hub and the contactor assembly having a non-rotatable portion connected to the second frame rail and remaining in a stationary position during the rotation of the hub, a portion of the non-rotatable portion of the contactor assembly slidingly contacting a portion of the rotatable portion of the contactor assembly for maintaining electrical continuity between the rotatable portion of the contactor assembly and the non-rotatable portion of the contactor assembly during the rotation of the contactor assembly with the rotation of the hub, one end of the cable being connectable to the rotatable portion of the contactor assembly for establishing electrical continuity between the cable and the contactor assembly and the sliding contact between the non-rotatable portion of the contactor assembly and the rotatable portion of the contactor assembly maintaining electrical continuity between the non-rotatable portion of the contactor assembly and the cable assembly by way of the rotatable portion of the contactor assembly during rotation of the contactor assembly with the rotation of the hub.

14. The reel of claim 1 wherein the removable hub generally is cylindrically shaped.

15. A reel adapted to be operatively connected to one end of a cable for winding portions of the cable onto the reel and for unwinding portions of the cable from the reel, comprising:

a generally cylindrically shaped hub having a diameter determined by the outer peripheral surface thereof and being operatively connectable to one end portion of the cable, the hub being rotatable in a winding direction for winding portions of the cable onto the hub and being rotatable in an opposite unwinding direction for unwinding portions of the cable from the hub;

a frame assembly supporting the hub and the hub being rotatingly connected to the frame assembly for rotation in the winding direction and in the opposite unwinding direction;

a first side plate having an outer peripheral surface and being connected to one end of the hub, the first side plate being generally circularly shaped and extending a distance radially outwardly from the outer peripheral surface of the hub;

a second side plate having an outer peripheral surface and being connected to the opposite end of the hub, the second side plate being generally circularly shaped and extending a distance radially outwardly from the outer peripheral surface of the hub, the second side plate being spaced a distance from the first side plate by the hub and the space between the first and the second side plates cooperating with the outer peripheral surface of the hub to form a cable retaining space, the first and the second side plates cooperating with the hub to retain portions of the cable wound about the base generally within the cable retaining space; and a removable hub having a first end, a second end, an outer peripheral surface and an opening extending therethrough intersecting the first and the second ends, the diameter determined by the outer peripheral surface of the removable hub being larger than the diameter determined by the outer peripheral surface of the hub, the removable hub being removably disposable about the hub and the removable hub being rotatable in the winding direction and in the unwinding direction when removably disposed about the hub so portions of the cable are wound onto the removable hub when the removable hub is rotated in the winding direction and so portion of the cable are unwound from the removable hub when the removable hub is rotated in the unwinding direction in lieu of winding and unwinding such cable on or from the hub, the first end of the removable hub engaging a portion of the second side plate and the second end of the removable hub engaging a portion of the first side plate to wedge the removable hub generally between the first and the second side plates in an assembled position of the removable hub connected to the reel, the removable hub comprising:

a first hub segment having a first end, a second end, an inner peripheral surface, an outer peripheral surface, a first end face and a second end face, the first and the second end faces each generally extending between the first and the second ends of the first hub segment;

a second hub segment having a first end, a second end, an inner peripheral surface, an outer peripheral surface, a first end face and a second end face, the first and the second end faces each generally extending between the first and the second ends of the second hub segment, the first end face of the first hub segment being disposed near the first end face of the second hub segment and the second end face of the first hub segment being disposed near the second end face of the second hub segment in an assembled position of the first and the second hub segments, the first ends of the first and the second hub segments being disposed in a coplanar relationship and cooperating to form the first end of the removable hub, the second ends of the first and the second hub segments being disposed in a coplanar relationship and cooperating to form the second end of the removable hub in an assembled position of the first and the second hub segments, the inner peripheral surfaces of the first and the second hub segments cooperating to form the opening through the removable hub and the outer peripheral surfaces of the first and second hub segments cooperating to form the outer peripheral surface of the removable hub in an assembled position of the first and the second hub segments;

a hinge having a portion connected to the first hub segment generally near the second end face of the first hub segment and a portion connected to the second hub segment generally near the second end face of the second hub segment, the hinge hingedly connecting the first and the second hub segments for movement to the opened and closed positions, the first and the second hub segments being movable to the opened position wherein the first end faces of the first and second hub segments are spaced apart a distance sufficient to permit the first and the second hub segments to be positioned about the hub; and a spring having one end portion connected to the first hub segment and an opposite end portion connected to the second hub segment, the spring biasing the first hub segment toward the second hub segment.

* * * * *